US005671793A

United States Patent [19]

Lee

[11] Patent Number: 5,671,793

[45] Date of Patent: Sep. 30, 1997

[54] COMBINATION BLIND CONTROLLER

[75] Inventor: Paul Lee, Houston, Tex.

[73] Assignee: Enwig Corp., Houston, Tex.

[21] Appl. No.: 648,326

[22] Filed: May 15, 1996

[51] Int. Cl.[6] ..... E06B 9/30

[52] U.S. Cl. ..... 160/168.1 R; 160/176.1 R; 160/178.2 R

[58] Field of Search ..... 160/168.1 R, 176.1 R, 160/178.1 R, 172 R, 173 R, 177 R, 178.2 R, 321

[56] References Cited

U.S. PATENT DOCUMENTS

| | | | |
|---|---|---|---|
| 2,759,535 | 8/1956 | Berglind | 160/168.1 R |
| 3,129,750 | 4/1964 | Brandin | 160/168.1 R |
| 3,443,624 | 5/1969 | Toth | 160/176.1 R X |
| 3,633,646 | 1/1972 | Zilver | 160/168.1 R |
| 5,465,775 | 11/1995 | Biba et al. | 160/168.1 R |
| 5,472,035 | 12/1995 | Biba et al. | 160/168.1 R |
| 5,501,262 | 3/1996 | Inabe et al. | 160/173 R X |
| 5,513,687 | 5/1996 | Tuzmen et al. | 160/168.1 R |
| 5,553,649 | 9/1996 | Chisaka et al. | 160/168.1 R |
| 5,553,653 | 9/1996 | Rozon | 160/178.1 R X |

*Primary Examiner*—David M. Purol

[57] ABSTRACT

An improved controller for opening and closing a venetian blind vanes over a door or window opening. A pull cord is engaged with a pulley, which is moved with a loop cord selectively engaged with a cord lock attached to a handle. A rotatable switch in the cord lock is rotated, the cord lock grasps the loop cord, and the handle is moved downwardly to pull to loop cord. Such movement operates the pulley and pull cord to raise the blind vanes. When the cord lock is disengaged, the weight of the blind returns the components to the original position. A rotatable tilt switch or combination of rotatable tilt switches are attached to a tilt rod for selectively rotating the blind vanes. All cords are completely enclosed so that looped ends of the cords are not accessible to persons adjacent the window blind.

20 Claims, 2 Drawing Sheets

COMBINATION BLIND CONTROLLER

BACKGROUND OF THE INVENTION

The invention relates to a controller for operating a louvered blind. More particularly, the present invention relates to a blind controller that encloses an operating cord or chain within a handle having a rotatable switch for selectively gripping the operating cord.

Blind coverings such as venetian blinds shield window and door openings to block the passage of light and to provide privacy. Louvered window blinds are constructed from a plurality of louvers or vanes that can be individually rotated about an axis to open and to close the window blind. Typically, the rotation of such vanes is controlled by rotation of a wand attached to a gear mechanism or by pulling on a chain engaged with a gear mechanism.

In a window blind where the vanes are horizontally oriented, the window blind can be raised and lowered by pulling a cord attached to a mechanism that engages the cord to lock the location of the vanes at a desired elevation. Conventional blinds incorporate a looped cord having two cord lengths. The cord lengths are attached to a mechanism inside the blind that moves the vanes, and either cord length can be pulled to selectively open or close the blind vanes. U.S. Pat. No. 4,177,853 to Anderson et al. (1979) and U.S. Pat. No. 4,487,243 to Debs (1984) each disclose a blind having a wand for rotating the vanes and a pull cord for raising and lowering the vanes.

Such looped cords hang free from one side of the blind, and the necessary length of the looped cord depends on the width of the opening. Blinds for large openings require a looped cord extending to the floor, which creates a potential safety hazard for small children. Because of this hazard, efforts have been made to eliminate looped cords from blinds.

One concept in window blinds eliminates the looped cord by incorporating an electric powered drive mechanism which selectively operates the blind and the individual vanes. The electric mechanism substantially increases the cost of the window blind and increases the number of mechanical components subject to failure.

Another window blind concept is disclosed in U.S. Pat. No. 4,919,186 to Uecker, et. (1990), wherein an endless cord rotates a wheel and attached shaft to unwind and to rewind an endless pull cord for raising and lowering the vanes. Although this embodiment reduces the length of the operating cord, such cord is exposed to the operator.

One concept for raising blind vanes is disclosed in U.S. Pat. No. 5,472,035 to Biba et al. (1995), which disclosed a lift cord and an endless cord extending through a rotatable wand. An outer lift member engages both the lift cord and the endless cord and is mounted for movement along the outer side of the wand. A related concept was disclosed in U.S. Pat. No. 5,465,775 to Biba et al. (1995), which also depended on lift cords and an endless cord which both extend through a wand. A wand connector permitted rotation of the wand relative to the headrail, and the wand had an opening along one side of the wand for permitting the movement of a handle along the outer side of the wand.

Although these improved window blinds enclose cords within the operating components, these improvments are expensive to construct and require an elongated opening in the outer surface of the wand. Accordingly, a need exists for a window blind that is economical to manufacture, easy to use, and that provides an efficient apparatus for moving a blind relative to an opening.

SUMMARY OF THE INVENTION

The present invention provides an improved apparatus for moving vanes in a blind to shield an opening such as a window or door opening. The invention includes a header having a housing with an upper end attached to said header and a lower end distal from the header. A continuous pull cord is proximate to the header and is engaged to move the vanes across the opening. A rotatable pulley is engaged with the pull cord and is also engaged with a continuous loop cord having an upper looped end and a lower looped end. A handle moveable with respect to the housing is engaged with the lower looped end. A cord lock vertically moveable with the handle is operable to grip the loop cord so that the loop cord operates the pulley to move the pull cord, and a rotatable switch is attached to the cord lock to selectively engage and disengage the cord lock from the loop cord.

In other embodiments of the invention, a tilt mechanism can be included to rotate the vanes about the longitudinal axis of each vane, and includes a tilt controller proximate to the housing. The tilt mechanism can include a tilt rod, a switch, and a tilt cord attached therebetween. The switch can comprise one or move rotatable rings attached to the tilt cord. A brake can be engaged with the rotatable pulley to selectively prevent rotation of the pulley, and the cord lock can include a ball in contact with the loop cord and a stop.

DESCRIPTION OF THE PREFERRED EMBODIMENTS

Figure 1:
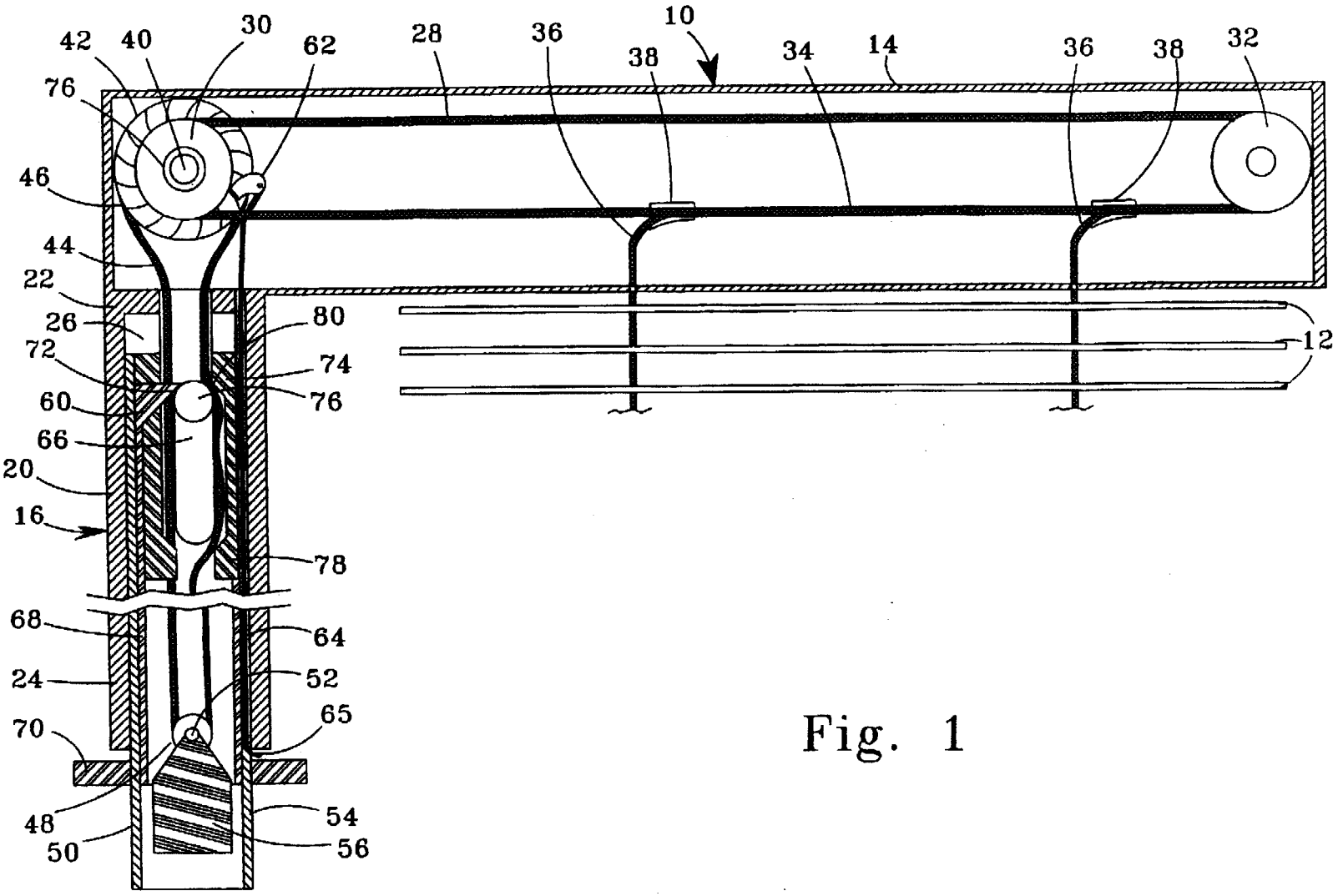
FIG. 1 illustrates an elevation view of the present invention.

The present invention describes an improved window blind which eliminates the potential hazard caused an exposed looped cord. As used herein, the term "cord" means a string, chain, rope, wire, or other flexible line for operating a mechanism. Referring to FIG. 1, blind 10 is generally formed with horizontal louvers or vanes 12, header or head rail 14, and control mechanism 16. Blind 10 is positioned adjacent to a window or door opening (not shown) for the purpose of blocking the transmission of light or air therethrough.

Head rail 14 is positioned near the opening top so that vanes 12 are suspended below head rail 14. Head rail 14 includes fixed housing 20 having upper end 22 rigidly attached to head rail 14 and having lower end 24 distal from head rail 14. Housing 20 includes hollow 26 for permitting the passage of other components as described below. Although the exterior surface of housing 20 is illustrated as a solid to enclose other components, housing 20 could be constructed as a bar, rod or frame member.

Continuous pull cord 28 is positioned within head rail 14, and is retained with pulley 30 and pulley 32. Pull cord 28 includes continuous loop 34 and pull cord sections 36 each having first end 38 attached to continuous loop 34. Pull cord sections 36 are engaged with vanes 12 so that rotation of continuous loop 34 around pulleys 30 and 32 moves pull cord sections 36 upwardly, thereby raising vanes 12 vertically across the opening. Movement of continuous loop 34 in the opposite rotational direction around pulleys 30 and 32 lowers pull cord sections 36 and vanes 12 across the opening.

Pulley 30 includes first pulley wheel 40 engaged with continuous loop 34, and further includes second pulley wheel 42 engaged with continuous loop cord 44. Loop cord 44 has upper looped end 46 in contact with second pulley wheel 42 and further has lower looped end 48 positioned with handle 50. In different embodiments of the invention, lower looped end 48 can be engaged with a pivot or pulley 52 attached to handle 50. Handle 50 is illustrated as an elongated member moveable relative to housing 20. In one embodiment of the invention, handle 50 can be positioned within hollow 26 of housing 20 so that handle 50 can reciprocate within housing 20. Grip 54 is attached to handle 50 and extends outside of housing 20. Weight 56 is attached to pulley 52 to prevent slack from accumulating within loop cord 44. In other embodiments of the invention, weight 56 can be replaced by a spring attached to handle 50 as described below. In the orientation shown in FIG. 1, handle 50 is prevented from falling away from housing 20 by loop cord 44. Handle 50 can be shaped as a cylinder, square, triangle, or other shape. If desired, a keyway or other restraining means (not shown) can be configured between handle 50 and housing 20 to prevent rotational movement therebetween, and the resulting entanglement of loop cord 44.

Rotatable switch or cord lock 60 is attached to handle 50 and is selectively engagable with loop cord 44. When cord lock 60 grips loop cord 44 and handle 50 is moved downwardly, the combination of cord lock 60 and handle 50 cooperate to rotate loop cord 44 in a clockwise direction as illustrated. This movement rotates second pulley wheel 42 and pulley 30, thereby moving pull cord 28 to raise vanes 12. Brake 62, which can be configured as a ratchet and prawl or other known mechanism, prevents pulley 30 from uncontrolled rotation in a clockwise direction. Brake 62 can be attached with brake release cord 64 to brake release 65 engaged with cord lock 60 so that selected movment of cord lock 60 pulls release cord 64, thereby disengaging brake 62. Following such disengagement and rotation of cord lock 60 to disengage cord lock 60 from contact with loop cord 44, the mass of vanes 12 will move downwardly due to gravity, pulling pull cord sections 36 downwardly, and moving pull cord 28 to rotate pulley 30 in a counterclockwise direction. Such rotation of pulley 30 will move loop cord 44 in a counterclockwise direction, thereby returning all of the components to the original position.

Cord lock 60 can be constructed in different ways within the scope of the invention. FIG. 1 illustrates one configuration of a cord lock wherein lock mechanism 66 is attached to extension 68, shown as an elongated bar positioned within the interior of handle 50. Extension 68 is attached to rotatable ring 70 positioned outside of handle 50 and rotatable about handle 50. The outer circumference of rotatable ring 70 can be serrated or otherwise shaped to facilitate contact between an operator's hand and rotatable ring 70. Rotation of rotatable ring 70 moves moves extension 68 and contact end 72, thereby operating cord lock mechanism 74.

Cord lock mechanism 74 can be constructed in different ways, and performs the function of selectively engaging or gripping loop cord 44. As illustrated in FIG. 1, cord lock mechanism 74 includes friction ball 76 which travels linearly within cage 78, and stop 80. Loop cord 44 contacts ball 76, and upward movement of loop cord 44 relative to ball 76 moves ball upwardly until ball 76 cooperates with stop 80 to grip loop cord 44. It will be appreciated that the relative upward movement of loop cord 44 relative to ball 76 can be accomplished by downward movement of handle 50 and the selective operation of rotatable ring 70. When rotatable ring 70 is moved in the opposite rotational direction, contact end 72 releases ball 76, brake 62 is released so that loop cord 44 can move in a counterclockwise direction, and ball 76 releases the grip on loop cord 44.

Figure 2:
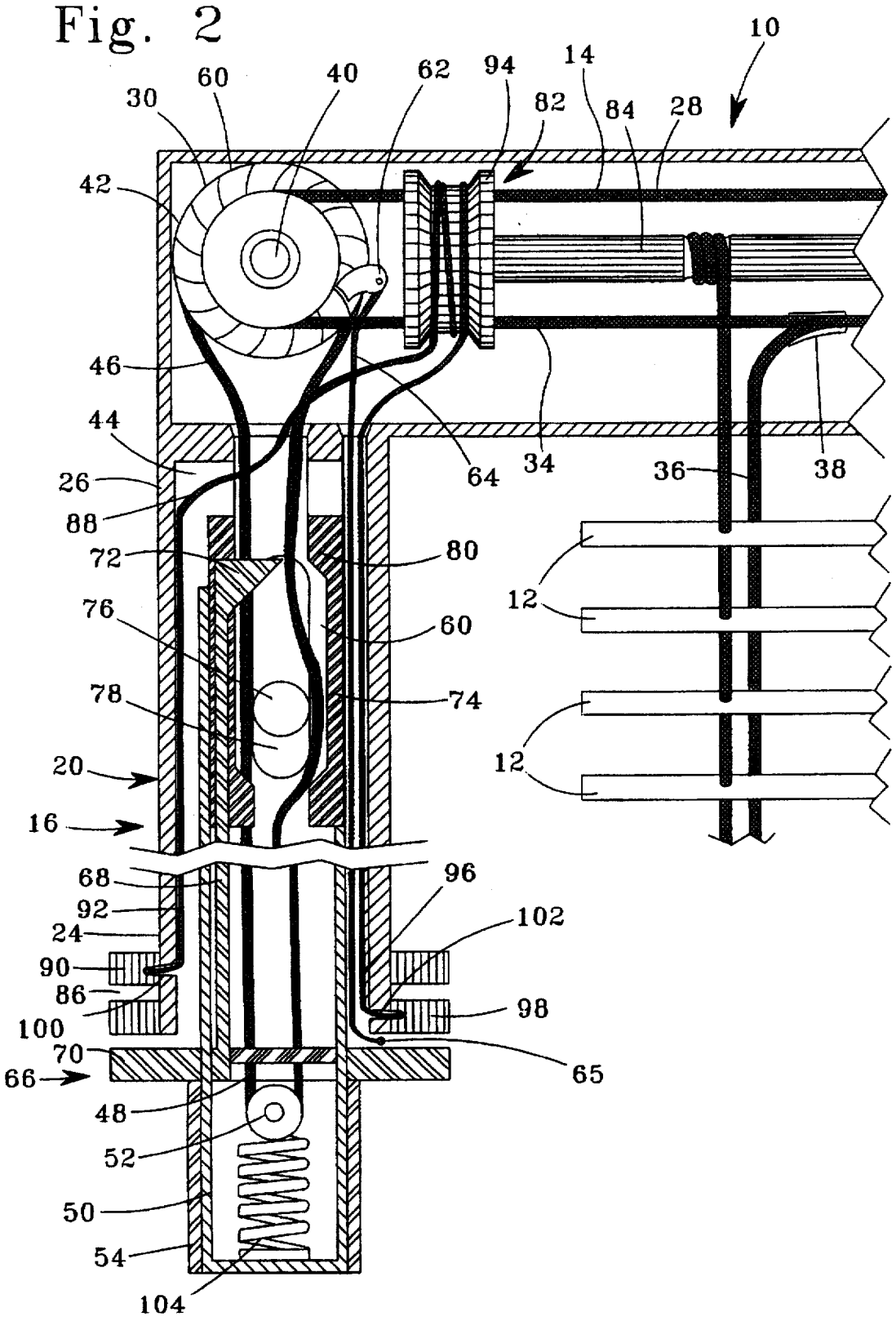
FIG. 2 illustrates a partial elevation view of the invention showing the cooperation of components to rotate and to vertically move the blind vanes.

Another embodiment of the invention is illustrated in FIG. 2, wherein tilt mechanism 82 is positioned to rotate each vane 12 about a longitudinal axis of the vane, thereby closing blind 10. Tilt mechanism includes tilt rod 84, tilt controller 86, and tilt cord 88 therebetween. Tilt controller 86 can comprise a single element or a conbination of rotatable rings as illustrated in FIG. 2. First annular ring 90 is positioned around the exterior surface of housing 20 and is attached to first end 92 of tilt cord 88. Tilt cord 88 is looped around spool 94 attached to tilt rod 84, and extends downwardly to second end 96 of tilt cord 88. Second end 96 is attached to second annular ring 98. First end 92 extends through aperture 100 in housing 20, and second end 96 extends through aperture 102 in housing 20. Aperture 100 fixes the segment length of tilt cord 88 between aperture 100 and spool 94, so that rotation of annular ring 90 about housing 20 pulls first end 92 through aperture 100. Such movement rotates spool 94 and attached tilt rod 84, thereby rotating vanes 12. To return vanes to the original orientation, ring 98 can be rotated relative to housing 20, thereby pulling second end 96 through aperture 102 to rotate spool 94 and tilt rod 84 in the opposite direction.

Spring 104 is attached between pulley 52 and handle 50 to permit movement between handle 50 and housing 20, and to provide a restoring force for returning handle 50 to the original position relative to housing 20. Spring 104 also cooperates to prevent slack from forming in loop cord 44.

In conventional window blinds, looped cords constitute a safety hazard to persons near the blinds. The present invention eliminates this problem by enclosing all cords within head rail 14 and handle 50.

Different forms of the invention can be constructed without departing from the inventive concepts disclosed. As representative examples, annular rings 90 and 98 can be formed into a single controller, tilt cord 88 can comprise one or more cords or rigid mechanical mechanisms, and cord lock mechanism 74 can be constructed in different ways to grip loop cord 44.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for moving horizontal vanes in a blind to shield an opening, comprising:

a header having a housing with an upper end attached to said header and a lower end distal from said header;

a continuous pull cord proximate to said header, wherein said pull cord is engaged with said vanes and is operable to selectively transport the vanes across the opening;

a rotatable pulley engaged with said pull cord for moving said pull cord to transport the vanes;

a continuous loop cord having an upper looped end engaged with said rotatable pulley and having a lower looped end;

a handle engaged with the lower looped end of said continuous loop cord, wherein said handle is moveable relative to said housing;

a cord lock for selective engagement with said loop cord and vertically moveable with said handle, wherein said cord lock is operable to grip said loop cord so that downward vertical movement of said handle pulls said loop cord, thereby moving said rotatable pulley to move said pull cord; and a rotatable switch attached to said cord lock for selectively engaging and disengaging said cord lock from said loop cord.

2. An apparatus as recited in claim 1, further comprising a weight attached to said handle for preventing slack from accumulating in said loop cord.

3. An apparatus as recited in claim 1, further comprising a brake engaged with said rotatable pulley for selectively preventing rotation of said pulley.

4. An apparatus as recited in claim 1, further comprising a tilt rod operable with said vanes for rotating the vanes about a longitudinal axis of each vane to close the blind.

5. An apparatus as recited in claim 4, further comprising a tilt controller engaged with said tilt rod for selectively operating said tilt rod to rotate the vanes.

6. An apparatus as recited in claim 5, wherein said tilt controller comprises a switch proximate to said housing lower end which is connected by a tilt control cord to operate said tilt rod.

7. An apparatus as recited in claim 6, wherein said switch is rotatable about said housing lower end.

8. An apparatus as recited in claim 1, wherein said cord lock includes a ball in contact with said loop cord, and wherein operation of said rotatable switch locks said ball against said loop cord to prevent movement of said loop cord relative to said housing.

9. An apparatus as recited in claim 8, wherein said rotatable switch is operable in the opposite rotational direction to unlock said ball from contact with said loop cord, thereby permitting the weight of the vanes to move the pull cord and rotatable pulley so that the vanes are lowered relative to the opening.

10. An apparatus for moving horizontal vanes in a blind to shield an opening, comprising:

a header having a housing with an upper end attached to said header and a lower end distal from said header;

a continuous pull cord proximate to said header, wherein said pull cord is engaged with said vanes and is operable to vertically transport the vanes across the opening;

a rotatable pulley engaged with said pull cord for moving said pull cord to transport the vanes;

a continuous loop cord having an upper looped end engaged with said rotatable pulley and having a lower looped end;

a handle engaged with the lower looped end of said continuous loop cord, wherein said handle is vertically moveable relative to said housing;

a tilt mechanism for rotating said vanes about a longitudinal axis of each vane to close the blind, wherein said tilt mechanism includes a tilt controller proximate to said housing;

a cord lock mechanism for selective engagement with said loop cord and vertically moveable with said handle, wherein said cord lock is operable to grip said loop cord so that downward movement of said handle pulls said loop cord, thereby moving said rotatable pulley to move said pull cord.

11. An apparatus as recited in claim 10, wherein said pulley has a first pulley wheel engaged with said pull cord and a second pulley wheel engaged with said loop cord.

12. An apparatus as recited in claim 10, wherein said tilt mechanism includes a tilt rod operable with said vanes for rotating the vanes and a tilt cord between said tilt rod and said tilt controller.

13. An apparatus as recited in claim 12, wherein said tilt rod is rotatably operable, and wherein said tilt controller includes a switch proximate to said housing lower end which is rotatable about said housing lower end to operate said tilt cord to rotate said tilt rod.

14. An apparatus as recited in claim 13, wherein said tilt cord comprises a first cord length and a second cord length, and wherein said switch comprises a first rotatable ring attached to said first cord length for rotating said cord rod in one direction, and said switch comprises a second rotatable ring attached to said second cord length for rotating said cord rod in the opposite direction.

15. An apparatus as recited in claim 14, wherein rotation of said first rotatable ring is transmitted by said first and second cord lengths to rotate said second rotatable ring.

16. An apparatus as recited in claim 10, wherein said cord lock mechanism includes a ball for engaging said loop cord, and further includes a rotatable switch for selectively engaging and disengaging said ball from said loop cord.

17. An apparatus as recited in claim 16, further said rotatable switch includes rotatable ring and an extension between said rotatable ring and said ball for permitting the placement of said rotatable ring below said ball.

18. An apparatus as recited in claim 10, further comprising a brake engaged with said rotatable pulley for selectively preventing rotation of said pulley.

19. An apparatus as recited in claim 10, further comprising a pivot engage with the lower looped end of said loop cord, and having a spring connected between said pivot and said handle.

20. An apparatus as recited in claim 16, further comprising a brake engaged with said rotatable pulley for selectively preventing rotation of said pulley, wherein said brake is engaged with said rotatable switch so that selected operation of said rotatable switch disengages said brake from said rotatable pulley.

* * * * *